US009655420B2

(12) United States Patent
Mathews, Jr.

(10) Patent No.: US 9,655,420 B2
(45) Date of Patent: May 23, 2017

(54) INSPECTION POUCH

(71) Applicant: D B Industries, LLC, Red Wing, MN (US)

(72) Inventor: William J. Mathews, Jr., Woodstock, GA (US)

(73) Assignee: D B Industries, LLC, Red Wing, MN (US)

( * ) Notice: Subject to any disclaimer, the term of this patent is extended or adjusted under 35 U.S.C. 154(b) by 0 days.

(21) Appl. No.: 14/698,113

(22) Filed: Apr. 28, 2015

(65) Prior Publication Data

US 2015/0305460 A1 Oct. 29, 2015

Related U.S. Application Data

(60) Provisional application No. 61/985,739, filed on Apr. 29, 2014.

(51) Int. Cl.

| | |
|---|---|
| ***A45C 11/00*** | (2006.01) |
| ***A45F 5/02*** | (2006.01) |
| ***A45C 13/02*** | (2006.01) |
| ***A45C 13/10*** | (2006.01) |
| ***A45C 13/30*** | (2006.01) |
| ***A45F 3/02*** | (2006.01) |

(52) U.S. Cl.

CPC ..... *A45C 11/00* (2013.01); *A45C 13/02* (2013.01); *A45C 13/1046* (2013.01); *A45C 13/30* (2013.01); *A45F 3/02* (2013.01); *A45F 5/021* (2013.01); *A45C 2011/003* (2013.01)

(58) Field of Classification Search

CPC ..... A45F 3/04; G06F 1/1628; A45C 13/02; A45C 2011/003; A45C 3/02

USPC ..... 224/904, 257, 276, 584; 206/320, 576

See application file for complete search history.

(56) References Cited

U.S. PATENT DOCUMENTS

| | | | | |
|---|---|---|---|---|
| 3,144,014 | A * | 8/1964 | Mantell, Jr. | A45F 3/04 126/38 |
| 5,560,524 | A * | 10/1996 | Brune | A47C 4/52 224/153 |
| 6,318,552 | B1 * | 11/2001 | Godshaw | A45C 3/02 190/109 |
| 6,321,912 | B1 * | 11/2001 | Lippert | A45C 5/14 206/320 |
| 6,597,568 | B2 * | 7/2003 | Ryder | G06F 1/1628 206/576 |
| 7,165,706 | B2 * | 1/2007 | Barr | A45C 7/009 224/661 |
| 8,453,896 | B1 * | 6/2013 | Mansell | A45C 3/001 206/287 |
| 8,584,916 | B1 * | 11/2013 | Chen | A45F 5/021 224/199 |
| 9,078,501 | B2 * | 7/2015 | Johnson | A45C 13/02 |
| 2002/0084299 | A1 * | 7/2002 | Sorensen | A45F 3/14 224/661 |

(Continued)

*Primary Examiner* — Peter Helvey

(74) *Attorney, Agent, or Firm* — Dicke, Billig & Czaja, PLLC

(57) ABSTRACT

An inspection pouch for housing and providing hands-free access to electronic testing equipment, meters, lights, tools and other implements needed by inspectors, installers and other workers. The pouch has a main compartment forming a tray with a cover therefor, the main compartment capable of being suspended from the cover at angles between zero and ninety degrees to enable viewing of equipment staged in the main compartment.

20 Claims, 4 Drawing Sheets

(56) References Cited

U.S. PATENT DOCUMENTS

| | | | | |
|---|---|---|---|---|
| 2003/0029755 | A1* | 2/2003 | Ho | A45C 3/02 206/320 |
| 2005/0098594 | A1* | 5/2005 | Truong | B60R 11/0264 224/275 |
| 2006/0118376 | A1* | 6/2006 | Godshaw | A01K 1/0254 190/107 |
| 2006/0144662 | A1* | 7/2006 | Hu | A45C 13/02 190/110 |
| 2007/0235491 | A1* | 10/2007 | Harris | A45F 5/02 224/671 |
| 2010/0307649 | A1* | 12/2010 | Santos Dominguez | A45C 13/02 150/107 |
| 2013/0082077 | A1* | 4/2013 | Millman | A45F 4/02 224/153 |
| 2014/0166704 | A1* | 6/2014 | Perera | A45F 3/04 224/153 |
| 2014/0203057 | A1* | 7/2014 | Goryl | A41D 13/0012 224/576 |

* cited by examiner

INSPECTION POUCH

CROSS REFERENCE TO RELATED APPLICATION

This utility application claims the benefit of and priority to U.S. provisional application entitled, "Inspection Pouch," having Ser. No. 61/985,739, filed Apr. 29, 2014, which is entirely incorporated herein by reference.

BACKGROUND

Workers, such as construction workers, electricians, insulators, maintenance workers, pipe fitters, welders, iron workers, etc. often transport and use meters, test equipment, and flashlights at height on worksites. It is important these tools are easily accessed while performing their work. For example, many such workers wear tool belts that have tool pouches that are designed to hold tools when they are not in use. Because the tools are supported on a workers person, the worker need not return to a toolbox or tool room when a given tool is required to do their job on a worksite. These tool pouches are primarily used for transportation and storage.

In some situations, a meter carried by the worker may fall out of its tool bag, tool bucket, or storage holster. For instance, if the worker is an electrician, a hand held meter might fall out of its storage pouch as the worker climbs about the work area. In other situations, the worker may simply drop the meter after having removed the meter from its holster or storage pouch. In either case, it is inconvenient for the worker to retrieve a dropped object. Additionally, it is very expensive to repair and/or replace if the meter is broken as a result of falling to the ground. Moreover, a falling meter or inspection device can injure or kill other workers if struck by said instrument at a given worksite.

At present, some meters are provided with an attached magnet, which serves to hold the meter to a metal cabinet, for example. However, many such meters are not equipped with a magnet, there may be no metal surface to attach to, and, where the magnet and metal cabinet are present, the meter may be forgotten and consequently lost. Additionally, some meters and devices are attached to the workers' belt. The device is normally contained inside a pouch with a clear plastic film on the front so the worker can see the control panel. While it may be possible to operate the keys by pushing the buttons from the outside of the pouch, it may require removing the device from the pouch. Other issues arise when the plastic film becomes dirty, impairing the vision of the worker. Glare is also a problem when using the system in the sunlight. When using the device inside, dim light may hinder usage if the plastic film is impaired.

From the above discussion, it can be appreciated that it would be desirable to have a means for preventing tools and/or meters from dropping when used at height, from being damaged through adverse handling or conditions, or from simply being left behind at a job site.

SUMMARY

It is, therefore, one of the objects of the present disclosure to provide an inspection pouch designed to house and provide access to meters, test equipment, flashlights, small tools etc. The pouch is designed to be secured to the worker for transport and to provide safety and security to the equipment and to other workers. The pouch, in an open configuration, provides a convenient, hands-free support surface that provides accessibility to items contained therein and is adjustable to accommodate the needs of the worker. These and additional features are set out in the accompanying drawings and detailed description.

The worker can control the device while positioned off of the shoulder with a strap. This positions the pouch off of the chest/stomach while hung around the neck. Belt and/or harness loops may be provided to position the pouch off of the belt while secured by the tool belt. The pouch is also outfitted with d-rings for securing the device (i.e. a meter) to the pouch. Pockets inside the pouch are used for securing the tools used with the device. The worker may also store additional small tools and/or accessories inside the pouch which is typically not available with traditional pouches provided by manufacturers of these types of devices. A feature not found in the prior art is the pouch is designed to work with any manufacturer's device. Thus, the present pouch is universal.

BRIEF DESCRIPTION OF THE DRAWINGS

The present disclosure may be better understood with reference to the following figures. Matching reference numerals designate corresponding parts throughout the figures, which are not necessarily drawn to scale.

DETAILED DESCRIPTION

As described above, it would be desirable to have a means for preventing meters, test equipment, flashlights, and small tools from dropping while being transported and used at height. Disclosed herein is a universal inspection pouch that is specifically adapted to retain tools, such as meters, gauges, test equipment, flashlights, and small tools that could either fall out of a holster or simply be dropped by the user.

The inspection pouch is worn off of the tool belt or a harness and used around the waist level, or hung off the neck and used off of the chest. The inspection pouch has several embodiments that provide positive control of various objects that are used by the worker. Several pockets are positioned inside the pouch and are used for storing test equipment, meters, measuring devices, flashlights, and small tools. Additionally, the inspection pouch contains a support element (D-Rings) for supporting test equipment, meters, measuring devices, flashlights and small tools on or inside the pouch during transit and use of the tools and/or equipment. The D-Rings are used as engineered attachments points for a tool lanyard to be attached during use. If the tool falls out of the pouch or is dropped by the user while working at height, the lanyard prevents the tool from falling more than a few feet from the pouch.

Figure 1:
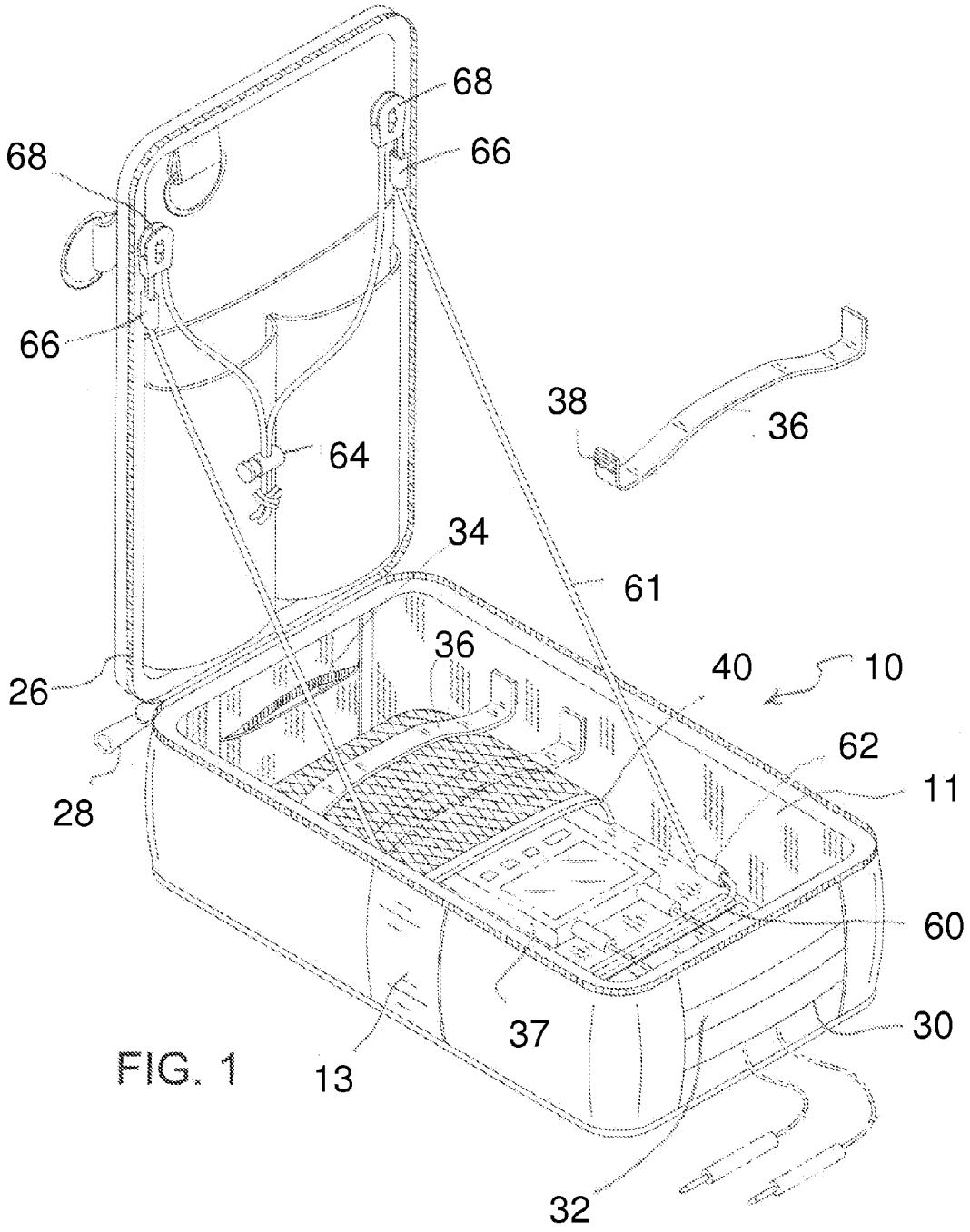
FIG. 1 is a perspective view of the inspection pouch in an open position.

Referring to FIG. 1, numeral 10 designates generally the present inspection pouch, which is normally heavy-duty polyester material with hard body material sewn inside. The material used to cover the hard-body material is consistent with polyester, nylon, vinyl, leather, cotton, or any suitable material. The hard-body material inside the outer shell can be made of composite, plastic, cardboard, aluminum, or any material suitable for this application. The pouch has a main compartment 11 and a cover 12. FIG. 1 illustrates the operational position of the pouch and FIG. 2 illustrates the transport position.

FIG. 1 numeral 13 shows the elastic strip sewn onto the gusset of the pouch. This strip is to be used as a hanging mechanism for meter leads or wands fed through the bottom or top of the pouch. It is used for staging these items when not in use. This function can also be accomplished by using nylon, polyester, leather, flexible plastic, vinyl, or other suitable materials.

Figure 2:
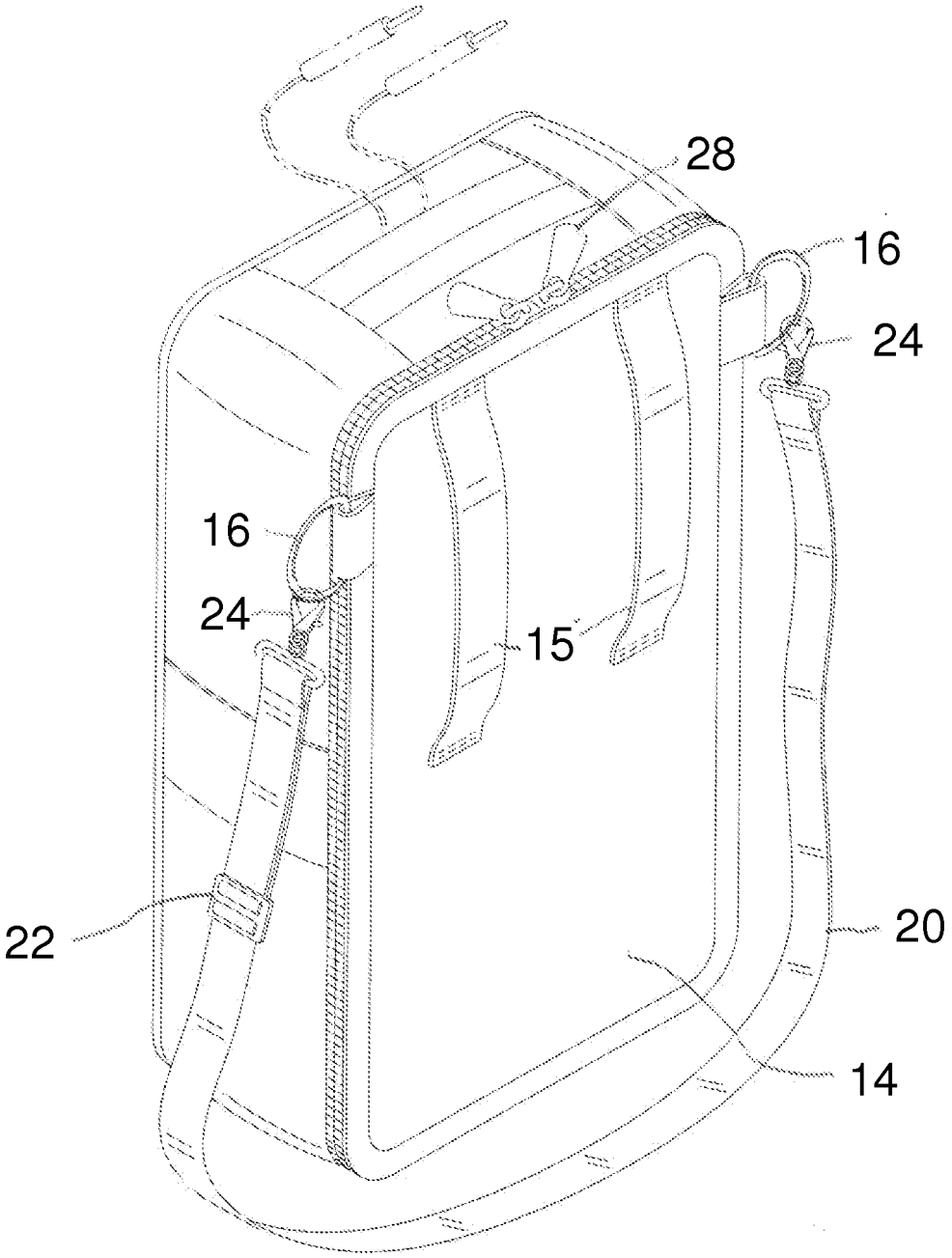
FIG. 2 is a perspective view of the rear of the pouch in a closed position.

FIG. 2 numeral 14 shows the back of the pouch that is made from polyester, nylon, vinyl, leather, cotton, or any suitable material. FIG. 2 numeral 15 illustrates the belt loop straps used for staging the pouch off of the users tool belt. Straps (not shown) may also be provided for staging the pouch off of a users' harness. The material used for these straps can be nylon, polyester, cotton, leather, plastic or any suitable materials.

FIG. 2 numeral 16 illustrates the d-ring attachment points used as engineered attachment points for tool lanyards when used to tether tools or electronics in or around the pouch during use. Additionally, the d-rings serve as a connection point for the shoulder strap 20. The d-rings are welded steel. Other materials suitable for this application would be stainless steel, or other suitable material. Additionally, the d-ring shape could also be round, triangle, square, rectangular, etc.

FIG. 2 numeral 20 shows the shoulder strap, which is used to hang the pouch off of the users neck. This strap allows the user to work with the meter positioned in the pouch off of the chest. This is what is referred to as "hands free". The strap uses a metal buckle 22 for adjusting the length to fit a wide range of users. FIG. 2 numeral 24 shows the metal snaps used for attaching to the d-ring attachment points 16. These snaps are metal but could also be stainless, composite, plastic, or any suitable material. The type of snaps can be any embodiment for attaching the strap to the d-ring attachment points. The buckle 22 can be steel, stainless, plastic, composite, or any suitable material.

In FIG. 1 numeral 26 illustrates the zipper system used to open and close the pouch. When the pouch is open and suspended from the workers' belt or shoulder strap, the pouch is in the hands free position for using the meter while it is positioned inside the pouch. The zipper is made of steel but could also be made of plastic or other material, depending on the application. The size of the zipper material might also change from a number 1 zipper, to a number 12 zipper depending on the application. The zipper pull-tabs 28 can be metal, plastic, or any suitable materials. This includes potentially using material as an extension to the metal pull tabs on the zipper, such as a leather pull cord or the like. While a zipper is shown, alternate securing means are also contemplated and considered within the scope of the present disclosure.

At the top of the inspection pouch, numeral 30 illustrates the slit included on the top of the pouch. This pass-through opening is provided in order for the user to feed the meter leads, or inspection wands through the opening. This assists in keeping the electronic equipment inside the pouch stable while the pouch is open and the user is operating the equipment. Additionally, this opening allows the user to operate the equipment when the pouch is in the closed position. For example, the meter might use a wand that is operational from the end of the wand. This eliminates the need for the meter itself being exposed to the elements, or placed in a position that exposes it to being dropped while at elevation. Such meters and like equipment are typically costly to replace and dangerous to those working below if the meter were to be dropped. Numeral 32 illustrates a reflective material used on the pouch. This is useful for identifying the pouch if left in an enclosed or darkened area. This is important in work areas where foreign material is a concern.

The bottom of the pouch in FIG. 1 illustrates a second pass through opening 34. This pass through opening is provided in order for the user to feed meter leads or inspection wands through the opening. This assists in keeping the electronic equipment inside the pouch secure during use or during transit. The top and bottom slits, 30 and 34, respectively, normally use hook and loop material to keep the slits closed when not in use. This is necessary to keep small parts from potentially exiting the pouch during transit. Metal snaps, plastic snaps, magnets, or any suitable materials can also be used to secure these openings.

FIG. 1 shows an inside view of the inspection pouch. The body of the main compartment and the sides are flexible hard-body material. This material can be cardboard, thin flexible metal, aluminum, or any suitable material. The inside is designed to act as a tray for the meter or testing equipment to rest. The tray configuration, with a generally flat supporting surface as the base, surrounded by upright, raised walls, is another improvement over known prior art pouches as it is shields the equipment from the glare of sunlight or brightly lit interiors to facilitate the users' ability to see various screens, dials, buttons, etc. A loop material 35 is used as padding on the inside of the main compartment. This material could be felt or any soft material suitable for the application. A number of auxiliary securing straps 36 are provided for securing test equipment, such as meter 37 (shown in broken lines). The straps 36 are elastic material or a suitable substitute, to accommodate meters of different sizes. The ends of the straps have a hook material 38 for mating with the loop material 35 that doubles as padding.

A fixed elastic strap 40 is also used to hold meters, sensors, or test equipment in place while positioned inside the pouch. The use of this strap is dependent on the meter or equipment used. Any type of flexible material can also be used.

A mesh pocket 42 is disposed inside the pouch. This pocket is another way to secure the meter while positioned inside the pouch. As there are many types of meters, gauges, and test equipment, the inspection pouch must adapt to the various types in order to allow for them to function correctly while used inside the pouch. The pocket is normally a flexible material and may be translucent so the user can still use the equipment while it is staged in the pouch.

Figure 3:
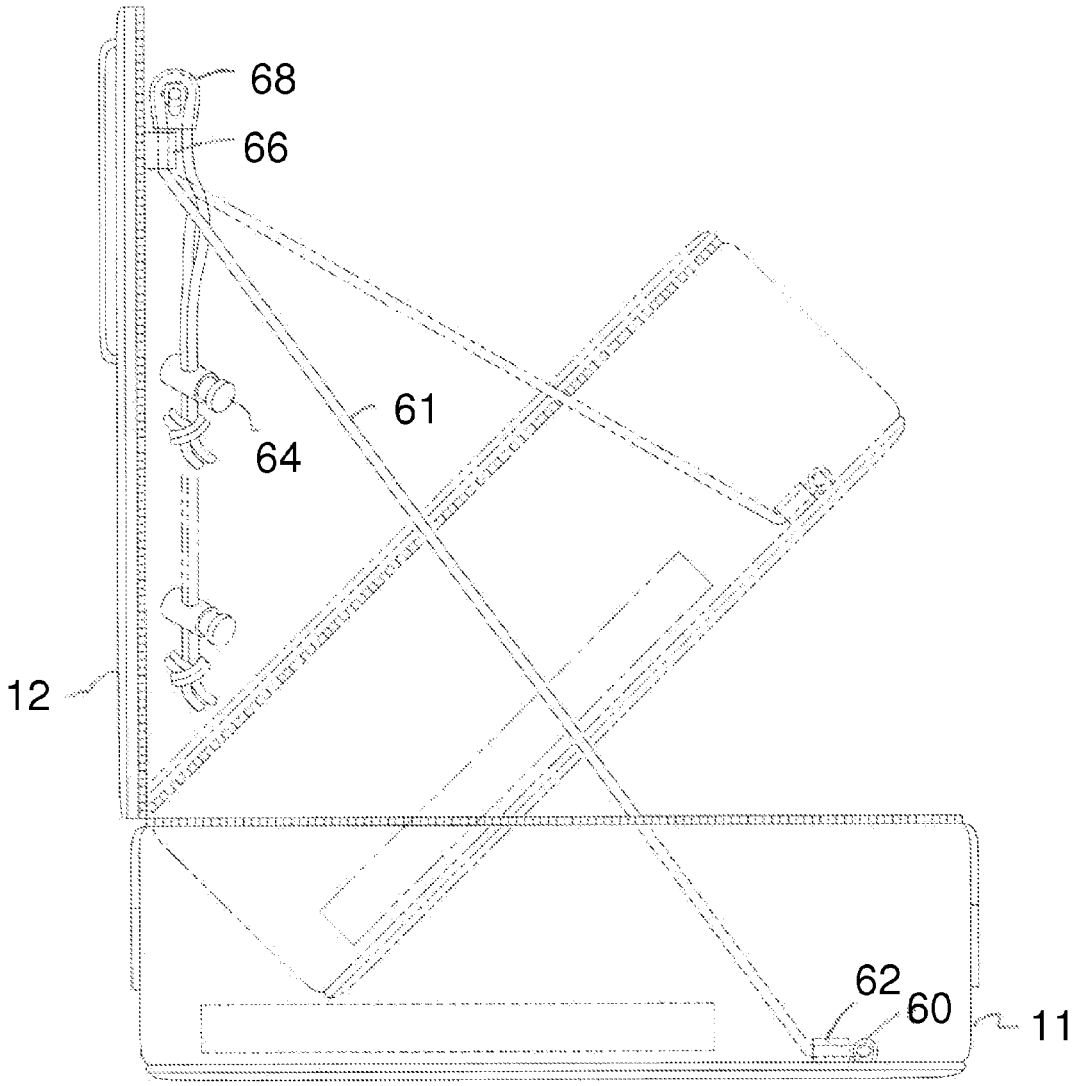
FIG. 3 is a side elevational view of the open pouch, the phantom lines indicating an alternate position.
Figure 4:
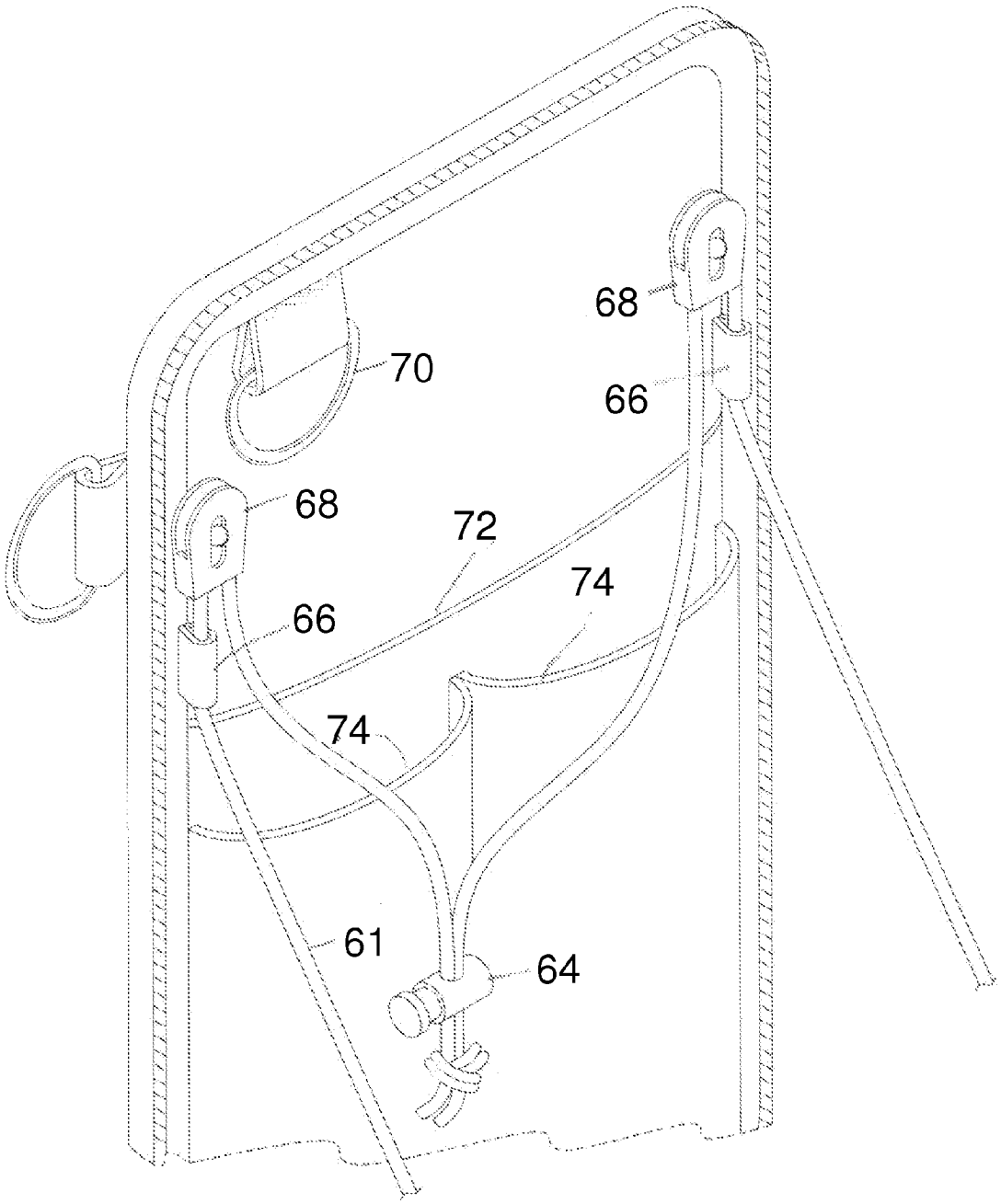
FIG. 4 is a partial, enlarged view of the adjustment means.

FIGS. 1, 3, and 4 illustrate the hinge system used for keeping the pouch open during use of the meter or test equipment inside. The hinge system is adjustable which allows the user to use the equipment staged inside the pouch. In FIG. 1, numeral 60 illustrates a strip of webbing used to cover the cord 61 used to adjust the opening. The cord is thus secured and does not move appreciably under the webbing except that it is able to laterally slide. Numeral 62 shows the hinge gates. These are used to position the cord at a particular angle not exceeding 45 degrees. Over extension of the angle would allow the contents inside to spill out which defeats the purpose of the pouch which is to allow the user to work hands free with the meter or test equipment.

As noted above, numeral 61 shows the cord material used to adjust how the pouch is staged in the open position. The cord material is polyester material. Bungee cord, hemp cord, nylon cord, cable, webbing and any material suitable to use in this embodiment is appropriate. The cord 61 has a cord lock 64, or barrel lock, used as a stop point for adjusting the opening of the pouch. This cord lock can be plastic or metal and of any shape or style that assists in locking the cord or webbing into place as a stop point. The cord feeds through two tubular pieces of webbing 66, which act as hinges and create the angles necessary for the worker to stage the pouch off of the hip or off of the chest while using the equipment inside the main compartment. Locking stops 68 create a fixed structure for adjusting the length of the cord on each side of the pouch. The stops can be any suitable material and any suitable configuration to lock the cord in the desired position.

FIG. 3 illustrates one of the adjustability features of the present pouch. In one embodiment, the main compartment 11 and the cover 12 are disposed approximately ninety degrees from one another. In the embodiment shown in phantom lines, the main compartment and the cover are disposed approximately forty-five degrees from one another. The degree of angular displacement is variable and can be set to any angle between and including approximately ninety degrees to approximately zero degrees, depending on the desire of the user and the equipment staged in the pouch. As will be appreciated, when the pouch is secured, either by the strap around the user's neck, or when suspended from a belt on harness worn by the user, the main compartment forms a tray that keeps the equipment therein with easy viewing distance of the user while allowing the user to have both hands free for other activities, such as manipulating the leads or wands that are attached to the meter, test equipment, etc.

In operation, when adjusting from the ninety degree position to the forty-five degree position, for example, the user needs to shorten the length of the cord 61. This is accomplished by first unlocking the stops 68, raising the main compartment and pulling the cords in through the unlocked stops 68, using the cord lock 64. When the desired position is reached, the stops 68 are re-locked, and the cord lock 64 is then unlocked to allow the slack in the cord to be taken up. The cord lock is then locked in the new position and the main compartment is reset in the raised orientation. The cord lock (barrel lock) is used as a secondary stop for preventing the cord from slipping when stops 68 are secured into the desired position. Stops 68 set the angle and secure it. Barrel lock 64 is a secondary guard against the cord slipping once stops 68 are set.

The inside wall of the cover 12 includes one or more D-rings which serves as an attachment point for lanyards used to secure tools, flashlights, etc. Also included are a large pocket 72 and two smaller pockets 74. Any number of pockets is contemplated and included in the present disclosure.

While an embodiment of an inspection pouch and modifications thereof have been shown and described in detail herein, various additional changes and modifications can be made without departing from the scope of the present disclosure.

PARTS LIST—INSPECTION POUCH

10—entire pouch
11—main compartment
12—cover
13—strap on side
14—back panel
15—belt loop straps
16—side D-rings
20—shoulder strap
22—strap buckle
24—strap end snaps
26—zipper
28—zipper pulls
30—top slit
32—reflective strip
34—bottom slit
35—loop material inside pouch
36—auxiliary straps
37—meter
38—hook material on straps 36
40—fixed strap
42—mesh pocket
60—strip even cord
61—cord
62—hinge gates
64—cord lock
66—webbing (tubular)
68—upper stops for cord
70—inside D-ring
72—big pocket
74—smaller, rounded pockets

I claim:

1. An inspection pouch comprising a main compartment with a securable cover, the main compartment forming a tray for receiving and displaying testing equipment, and a hinge system for connecting said main compartment and cover, said hinge system including length-adjustable cord portions for maintaining said main compartment a fixed distance from said cover, said length-adjustable cord portions interconnecting opposing sides of said main compartment and cover, said length-adjustable cord portions connected to said cover with stops and having respective ends connected to one another with a lock between said stops.

2. An inspection pouch as defined in claim 1 in which said main compartment includes adjustable securing straps therein for securing items disposed in the pouch.

3. An inspection pouch as defined in claim 1 in which said stops are lockable stop members for holding said cord portions in a fixed position.

4. An inspection pouch as defined in claim 3 in which said stop members are unlockable for adjusting the length of said cord portions.

5. An inspection pouch as defined in claim 1 in which said main compartment includes a top wall and a bottom wall and said walls include access openings in communication with the main compartment.

6. An inspection pouch as defined in claim 1 in which said cover includes at least one loop for receiving the belt of a user.

7. An inspection pouch as defined in claim 1 in which said pouch includes a shoulder strap for suspending said pouch from the shoulders of a user.

8. An inspection pouch for holding and securing test equipment and tools therein, comprising a main compartment with a selectively securable cover, said pouch having a use orientation and a transport orientation, said cover including a securing member for attaching said pouch to a user, said main compartment forming a tray for displaying the contents therein to the user when in a use orientation, and a length-adjustable hinge system extending between said cover and said main compartment for holding said main compartment a selected distance from said cover, said length-adjustable hinge system including cord portions interconnecting opposing sides of said main compartment and said cover, said cord portions connected to said cover with stops and having respective ends connected to one another with a lock between said stops.

9. An inspection pouch as defined in claim 8 in which said main compartment includes adjustable securing straps therein for securing items disposed in the pouch.

10. An inspection pouch as defined in claim 8 in which said stops are lockable stop members for holding said cord portions in a fixed position.

11. An inspection pouch as defined in claim 8 in which said tray is formed using a base and surrounding walls.

12. An inspection pouch as defined in claim 8, in which said main compartment and cover can extend from zero degrees to ninety degrees apart, inclusive.

13. An inspection pouch as defined in claim 8 in which the stops are positioned on the cover.

14. An inspection pouch as defined in claim 8 in which each stop has a locked position in which the respective cord portion cannot slide around the respective stop and an unlocked position in where the respective cord portion can slide around the respective stop.

15. An inspection pouch as defined in claim 8 in which the cord portions are formed of a single piece of cord material.

16. An inspection pouch as defined in claim 1 in which the cord portions extend from opposing sides of the tray.

17. An inspection pouch as defined in claim 1 in which the stops are positioned on the cover.

18. An inspection pouch as defined in claim 1 in which each stop has a locked position in which the respective cord portion cannot slide around the respective stop and an unlocked position in where the respective cord portion can slide around the respective stop.

19. An inspection pouch as defined in claim 1 in which the cord portions are formed of a single piece of cord material.

20. An inspection pouch as defined in claim 1 in which the cord portions extend from opposing sides of the tray.

* * * * *